US005867748A

United States Patent [19]

Takahashi et al.

[11] Patent Number: 5,867,748

[45] Date of Patent: Feb. 2, 1999

[54] NOISE MASKING DEVICE AND METHOD FOR USE IN AN IMAGE FORMING APPARATUS

[75] Inventors: Masahiro Takahashi; Shinji Sasahara, both of Nakai-machi, Japan

[73] Assignee: Fuji Xerox Co., Ltd., Tokyo, Japan

[21] Appl. No.: 738,496

[22] Filed: Oct. 28, 1996

[30] Foreign Application Priority Data

Dec. 15, 1995 [JP] Japan ..... 7-347169

[51] Int. Cl.[6] ..... G03G 21/00

[52] U.S. Cl. ..... 399/1; 318/461; 318/128

[58] Field of Search ..... 318/445, 611, 318/628, 128, 71, 632, 635, 461, 463; 399/1, 9, 8, 94, 73.1; 310/51; 388/909, 930

[56] References Cited

U.S. PATENT DOCUMENTS

| | | | |
|---|---|---|---|
| 4,412,735 | 11/1983 | Tsukata et al. | 399/81 |
| 5,289,147 | 2/1994 | Koike et al. | 399/1 |
| 5,425,105 | 6/1995 | Lo et al. | 381/71.8 |
| 5,432,857 | 7/1995 | Geddes | 381/71.7 |
| 5,499,423 | 3/1996 | Joo et al. | 15/319 |
| 5,502,869 | 4/1996 | Smith et al. | 15/326 |
| 5,677,958 | 10/1997 | Lehringer | 381/71 |
| 5,689,194 | 11/1997 | Richards, II et al. | 318/490 |

FOREIGN PATENT DOCUMENTS

| | | |
|---|---|---|
| 63-59797 | 3/1988 | Japan . |
| 6-175443 | 6/1994 | Japan . |

*Primary Examiner*—Jonathan Wysocki
*Attorney, Agent, or Firm*—Oliff & Berridge PLC

[57] ABSTRACT

A noise masking device for a low-cost laser beam printer, a copier or the like for performing a noise masking with respect to a noise of a drive motor of an image forming apparatus while affording no psychological unpleasant feeling due to a frequency fluctuation thereof. The noise masking device of the image forming apparatus having the drive motor which becomes a source of the noise upon operation thereof includes signal generating means for generating a correlation signal which correlates with the noise, a speaker for generating a masking sound which masks the noise and masking sound control means for controlling the speaker to vary the masking sound corresponding to the variation in the correlation signal.

20 Claims, 10 Drawing Sheets

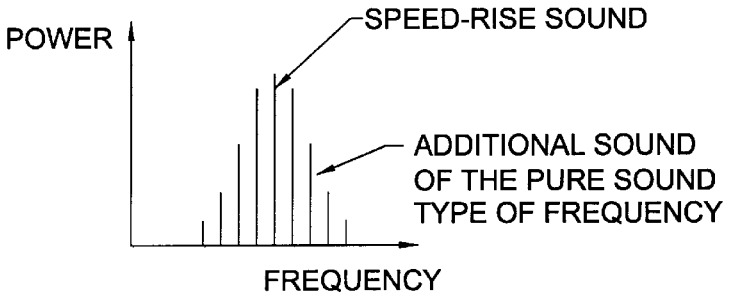
FIG. 8
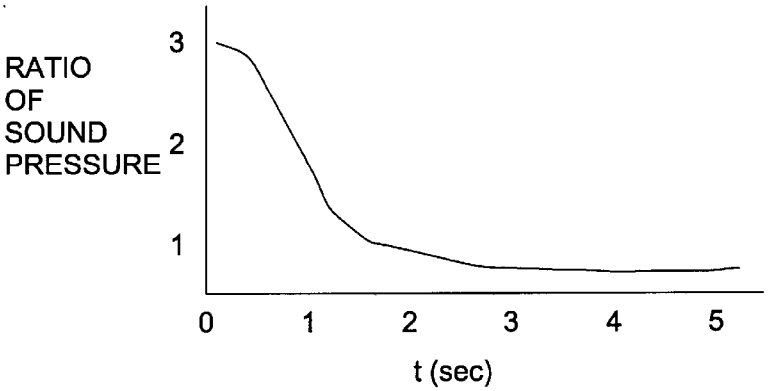
FIG. 9
| 20 RATES | 21 UNPLEASANTNESS | 22 SHRILLNESS | 23 NOISINESS |
|---|---|---|---|
| 5 | UNPLEASANT | SHRILL | NOISY |
| 4 | SLIGHTLY UNPLEASANT | SLIGHTLY SHRILL | SLIGHTLY NOISY |
| 3 | NEITHER UNPLEASANT NOR PLEASANT | NEITHER SHRILL NOR CALM | NEITHER NOISY NOR QUIET |
| 2 | SLIGHTLY PLEASANT | SLIGHTLY CALM | SLIGHTLY QUIET |
| 1 | PLEASANT | CALM | QUIET |
FIG. 10

NOISE MASKING DEVICE AND METHOD FOR USE IN AN IMAGE FORMING APPARATUS

BACKGROUND OF THE INVENTION

1. Field of the Invention

The present invention relates to a noise masking device and a noise masking method of an image forming apparatus such as an office automation equipment, a laser beam printer and an electrophotographic copier, using a drive motor which becomes a source of a noise upon operation thereof, and more particularly, to a noise masking device and a noise masking method for generating a noise masking sound which auditorily drowns out the noise produced by the drive motor of the noise source, to thereby drown out the noise which causes unpleasant feeling.

2. Description of the Related Art

Conventionally, a plurality of mechanical drive motors are utilized as drive motors for an image forming apparatus such as a laser beam printer and an electrophotographic copier. The recent digitization brings use of a special drive motor.

For example, an image carrier (document) is scanned by a fluorescent tube or an LED to read the image by a CCD in a digitized image forming apparatus. Recording of the image (making a document) is performed with an image recording apparatus by scanning a recording medium with a light beam from a light source such as a laser diode which is modulated with an image signal or a character signal. In this case, a light deflector which includes a polygon mirror having a plurality of reflecting facets on its outer peripheral and a drive motor for rotating the polygon mirror is used as a optical scanning device for scanning the light beam. An example of the drive motor of such light deflector will be subsequently explained.

FIG. 12 is a perspective view explaining a construction of a light deflector (an optical scanning device). In FIG. 12, designated at numeral 11 is a drive motor, 12 is a polygon mirror, 13 is a laser source, 14 is a collimator lens, 15 is a converging optical member (a converging lens) and 16 is a recording member (a photosensitive drum).

The construction of the light deflector in the image forming apparatus and the outline of the image forming method is schematically explained with reference to FIG. 12. On performing the image recording, the polygon mirror 12 is rotated by the drive motor 11 in the direction shown by an arrow A. The laser source 13 is constituted by a semiconductor laser or a gas laser. The light beam emitted from the laser source 13 is modulated with an image signal by a modulator not shown and is incident on one of the reflecting facets of the polygon mirror 12 through the collimator lens 14. The light beam reflected by the reflecting facet of the polygon mirror 12 is projected to the recording member 16 through the converging optical member 15. In this case, the reflected light beam is deflected in the direction shown by an arrow B for main-scanning the recording member 16 in accordance with the rotation of the polygon mirror 12 in the direction of the arrow A. With this main-scanning, the recording member 16 is rotated in the direction shown by an arrow C to perform sub-scanning, resulting in that a two-dimensional image is written on the recording member 16.

The drive motor used in such light deflector, for example, includes a rotational bearing such as a dynamic pressure air bearing or a ball bearing having a sleeve and a shaft mutually engaging, one of which is a rotational member and the other is a fixed member, a permanent magnet mounted to the rotational member and a magnetic circuit having an electromagnetic coil wound around a circular iron core mounted to the fixed member, whereby a rotational torque is generated. Namely, the drive motor has the magnetic circuit serving as a magnetic bearing for supporting the rotational member in an axial direction.

Therefore, a noise occurs due to the operation of the drive motor 11 when the above-mentioned image recording is performed. The noise produced according to the variation in the rotational speed of the drive motor is explained. As shown in FIG. 13, the noise is produced and varied in accordance with the rotational speed of the drive motor of the light deflector. FIG. 13 shows a process from when the power source of the image forming apparatus is turned on to when a series of image forming is terminated as a variation in the rotational speed (the noise) of the drive motor.

As shown in FIG. 13, when the power source is turned on, the rotational speed of the drive motor increases to a predetermined speed. If a predetermined operation does not start after keeping a constant rotational speed, the apparatus enters into a stand-by mode and decreases the rotational speed to enter into a resting state. Thereafter, when a beginning of procedures is instructed, a speed-rising of the drive motor is started. When the rotational speed of the drive motor increases to the predetermined speed, an operational drive of the drive motor is started for the predetermined procedures. After the operational drive of the drive motor is terminated, a part of fans stops rotating. The rotation in the predetermined period for cooling is continued and then the deceleration of the drive motor is started to decrease the rotational speed to that in the stand-by mode. Thereafter, the rotational speed of the stand-by mode is kept to maintain the stand-by state.

Namely, in the case where the procedures are not performed for a short while after the power source is turned on, the image forming apparatus is brought into the stand-by mode after a several to several ten seconds from the turning-on of the power source to restrain the consumption of electricity during the stand-by mode, so that almost all the mechanisms except for a radiation fan become in the resting state. Ordinarily, preparatory to the next operational drive, the light deflector during the stand-by mode is decelerated and driven at almost a half of the predetermined rotational speed in order to shorten a speed-rise period from when the drive motor starts up to when reaches the predetermined rotational speed. In recent years, there has been provided a type wherein the rotational speed falls down to zero in the stand-by mode in order to further reduce the consumption of the electricity during the stand-by mode.

When an operator pushes a button on a control panel to input a process start signal during the stand-by mode for performing the image forming process, the image forming apparatus is brought into an operational mode, whereby the drive motor of the light deflector is starting up to accelerate until reaching the predetermined rotational speed. At this time, it is necessary to rotate the drive motor of the light deflector at high speed in a short period from the viewpoint of an image forming cycle. Therefore, the drive motor of the light deflector is constructed to be used with the rotational speed higher than that of the general motor, so that the rotational speed of the drive motor of the light deflector is 5,000 rotations or more, and 10,000 rotations or more per minute according to the situation. Accordingly, a large electricity is sent to the drive motor upon starting-up to rapidly increase the rotational speed, to thereby produce a large noise. This noise is a fluctuating sound following the fluctuation of the rotational speed, and gets greatly on persons nerve to bring unpleasant feeling.

The image forming process is started to perform a series of procedures after the drive motor reaches the predetermined rotational speed. After the completion of the procedures, each mechanism of the apparatus enters into the resting state. In the case where the next procedure is not performed after a predetermined period, the image forming apparatus is changed over to the stand-by mode, and the drive motor enters a decelerated drive.

Conventionally, there has been proposed a technique for reducing the jarring noise occurring due to the frequency fluctuation. For example, Japanese Unexamined Patent Publication Nos. Sho 63-59797 (1988) and Hei 6-175443 (1994) propose such a technique. The former proposes a driving method for a stepping motor wherein a time variation of a frequency upon the speed-rise time of the drive motor is constructed to form a plurality of curve lines to ease a rapid change. Further, the latter proposes an image forming apparatus in which other operations of the image forming apparatus are separately and precedentially performed upon the speed-rise time of a driver motor for a polygon mirror so that the operational sounds overlap the sound of the drive motor for masking.

According to the above-mentioned conventional example, the time variation of the frequency is constructed to form a plurality of curve lines to eliminate psychologically unpleasant feeling due to the noise produced upon the speed-rise time of the drive motor of the light deflector, thereby being effective to some degree in easing the rapid change in the sound. However, the frequency fluctuation is almost recognized, so that it does not come to eliminate unpleasant feeling.

In the method according to the above-mentioned other conventional example in which the operational sound overlaps with the noise of the drive motor to mask the noise, the noise (sound volume) of the whole sound further increases to become noisy. Therefore, it is difficult to eliminate unpleasantness. During the period from when the power source is turned on or from when the image forming process is terminated to when the apparatus is changed over to the stand-by mode, the other portions of the image forming apparatus is continuously and separately operated, resulting in that it is unfavorable from the viewpoint of the reduction in the consumption of the electricity.

SUMMARY OF THE INVENTION

The present invention is accomplished in order to solve the above-mentioned problems and aims to provide a noise masking device for masking the noise for a small-sized and low-cost image forming apparatus, such as a laser beam printer and a copier, which brings no psychological unpleasantness due to the frequency fluctuation.

In order to accomplish this object, a first characteristic of the present invention, in a noise masking device of an image forming apparatus provided with a drive mechanism which is a source of a noise during an operation thereof, is characterized by comprising correlation signal generating means for generating a correlation signal which correlates with the noise, a sound generating member for generating a masking sound which masks the noise, and masking sound control means for controlling the sound generating member and varying the masking sound corresponding to the variation in the correlation signal.

The noise masking device of the image forming apparatus according to the present invention has a second characteristic such that the masking sound control means varies the frequency of the masking sound corresponding to the variation in the correlation signal. Further, as a third characteristic, the masking sound control means varies the sound pressure of the masking sound corresponding to the variation in the correlation signal.

The noise masking device of the image forming apparatus has further a fourth characteristic such that the masking sound is a pure sound type masking sound having a remarkable peak of the sound pressure at a particular frequency, and has a fifth characteristic such that the frequency distribution of the pure sound type masking sound is a symmetric distribution with respect to the particular frequency.

Moreover, a sixth characteristic of the present invention, in a noise masking method of an image forming apparatus provided with a drive mechanism which is a source of a noise during the operation thereof, is characterized by generating a correlation signal which correlates with the noise, varying a masking sound for masking the noise corresponding to the variation in the correlation signal, and generating the masking sound after the variation from a sound generating member.

The noise masking method of the image forming apparatus according to the present invention has a seventh characteristic such that the frequency of the masking sound is varied corresponding to the variation in the correlation signal. Further, as an eighth characteristic, the state of the variation of the masking sound varies the sound pressure of the masking sound corresponding to the variation in the correlation signal.

The noise masking method of the image forming apparatus has further a ninth characteristic such that the masking sound is a pure sound type masking sound having a remarkable peak of the sound pressure at a particular frequency, and has a tenth characteristic such that the frequency distribution of the pure sound type masking sound is a symmetric distribution with respect to the particular frequency.

In the noise masking device of the image forming apparatus of the present invention having these various characteristics, the correlation signal generating means generates the correlation signal which correlates with the noise, and then the masking sound control means controls the sound generating member which generates the masking sound, whereby the noise produced by the drive mechanism of the image forming apparatus during the operation is effectively masked.

In order to effectively mask the noise, the masking sound control means varies the frequency, or varies the sound pressure of the masking sound corresponding to the variation in the correlation signal. In the case of effectively performing the masking operation, the masking sound is a pure sound type masking sound having a remarkable peak of the sound pressure at the particular frequency. In this case, the frequency distribution of the pure sound type masking sound is a symmetric distribution with respect to the particular frequency, whereby the noise is effectively masked.

In the noise masking method of the image forming apparatus according to the present invention, the correlation signal which correlates with the noise produced by the drive mechanism of the image forming apparatus during the operation is generated, and then the masking sound for masking the noise is varied corresponding to the variation in this correlation signal. After this variation, the masking sound is generated from the sound generating member. By this, the noise of the image forming apparatus having the drive mechanism which is a source of the noise during the operation is effectively masked.

In order to effectively mask the noise in the noise masking method of the image forming apparatus according to the present invention, the frequency of the masking sound is varied corresponding to the variation in the correlation signal. Alternatively, the sound pressure of the masking sound is varied corresponding to the variation in the correlation signal. In this case, it is preferable that the masking sound is a pure sound type masking sound having a remarkable peak of the sound pressure at the particular frequency. Moreover, the frequency distribution of the pure sound type masking sound is a symmetric distribution with respect to the particular frequency.

Concretely, in the image forming apparatus of the present invention, for example, the rotational speed of the drive motor of the drive mechanism in the image forming apparatus is utilized as a correlation signal which correlates with the noise. With respect to the main component frequency of the noise which occurs when the rotational speed of the drive motor rises up to a predetermined speed or falls down, the rotational speed on the speed-rise time or the speed-fall time is detected. The masking sound is produced for adding such that the plurality of frequencies are positioned at both sides of the main component frequency with the detected signal as a trigger. These masking sounds are generated from the speaker as a sound wave by the timing control in synchronism with the periodical fluctuation of the main component frequency. Accordingly, the masking sound is added to form a sound having auditorily a wide band compared with the main component frequency, whereby the noise due to the main component frequency cannot be recognized.

In the case of varying the sound added as the masking sound, an operator increases or decreases the amplitude of the sound having the plurality of frequencies to generate as a sound wave from the speaker, to thereby form a sound auditorily having a wide band compared with the main component frequency. In this case, the operator adjusts the amplitude according to the degree of his or her recognition of the sound. Namely, the operator sets such that he or she or surrounding people does not recognize the sound by the main component frequency.

When the correlation signal which correlates with the noise is generated, a microphone is provided to observe the sound upon rising-up or falling-down of the rotational speed of the drive motor. The amplitude of the sound having the plurality of frequencies is increased or decreased in accordance with the amplitude of the main component frequency of these observed sounds to form the masking sound which is actively controlled in the amplitude. Then, the amplitude is kept in a predetermined state corresponding to the environmental change or changes in various conditions of the main component frequency. By this, the masking operation is performed such that the sound by the main component frequency is not recognized.

In the case of forming the masking sound to the noise, the sound of the plurality of frequencies serving as the masking sound is followed with respect to the rotational speed upon the rising-up or falling-down, to thereby keep the interval between the frequencies constant. As a result, it is possible that the sound by the main component frequency is not recognized while keeping the width of the sound constant.

The sound having the plurality of frequencies added as the masking sound has a frequency distribution which is a symmetric distribution with respect to the main component frequency. Particularly, the frequency distribution corresponds to any one of a triangular distribution, a trapezoidal distribution and a normal distribution. As a result, a sensitivity of the frequency spaced apart from the main component frequency is restrained to ease the sound of the plurality of frequencies, whereby the sound by the main component frequency is not recognized.

Moreover, the sound having the plurality of frequencies added as the masking sound is a frequency of the pure sound type which is gathered to form auditorily a wider band for adding to the main component frequency. By this, the sound of the main component frequency which is the pure sound type and has a shallow band is difficult to be recognized with the frequency of the same type.

Further, the sound having the plurality of frequencies added as the masking sound is added continuously to the steady sound after the rising-up or before the falling-down, resulting in that the sound produced when the main component frequency varies from transient state to steady state or from steady state to transient state is difficult to be recognized. Moreover, the sound of the pure sound type having the plurality of frequencies added as the masking sound is mutually interferes with the main component frequency to control the sound pressure, reducing the auditory sound degree such as noisiness, unpleasantness and getting on ones nerve.

According to the noise masking device of the image forming apparatus of the present invention having these various characteristics, the sound due to the frequency fluctuation generating upon the rising-up or falling-down of the rotational speed of the drive motor is difficult to be recognized, to thereby restrain the psychological unpleasantness. Further, the operator adjusts the masking sound according to the degree of his or her recognition to set to the degree such that the sound due to the main component frequency of the drive motor is not recognized by the operator or surrounding people. Therefore, the unpleasant feeling can be restrained according to the mans sensitivity.

Moreover, the amplitude of the sound of the plurality of frequencies added as the masking sound can be kept at a predetermined state corresponding to the environmental change or changes in various conditions, with the result that the unpleasant feeling can be stably restrained. Further, the sound produced when the main component frequency of the drive motor varies from the transient state to the steady state or from the steady state to the transient state is difficult to be recognized, to thereby eliminate the sense of incongruity caused by the variation of the sound to the operational state or to the stopped state.

Further, the operational sound of the drive motor upon operation or a part of the operational sound upon operation does not overlap, resulting in that it is unnecessary to lengthen the period for continuing the masking sound with respect to these noises, as well as that there is no need of electricity for operating. Moreover, the plurality of frequencies of the pure sound type is mutually interfered with the main component frequency for restraining the sound pressure, thereby reducing the degree of recognition of the sound such as noisiness, unpleasantness and getting ones nerve. These noise-counter measures can be realized by a simple and low-cost construction with respect to the sound-counter measure by a complicated construction or a expensive silencer.

BRIEF DESCRIPTION OF THE DRAWINGS

FIG. 8 is a view illustrating the frequency distribution of the additional sound in the case where the plurality of frequencies serving as the additional sound are the pure sound type set;

FIG. 9 is a view explaining the embodying example of the decrease of the noise in the case where the plurality of the frequencies of the pure sound type mutually interfere with the main component frequency to control the sound pressure;

FIG. 10 is a view showing one example of a table affording evaluation results by a category evaluating method;

DESCRIPTION OF THE PREFERRED EMBODIMENTS

Embodiments according to the present invention will concretely be explained hereinbelow with reference to the drawings. Although preferred embodiments of the present invention is explained, the present invention should not be limited to the embodiments. Explained here is only the occurrence of a sound upon a speed-rise time of a drive motor. The occurrence of a sound upon a speed-fall time of the drive motor is omitted because it is periodically reverse to the case of the speed-rise time.

Figure 1:
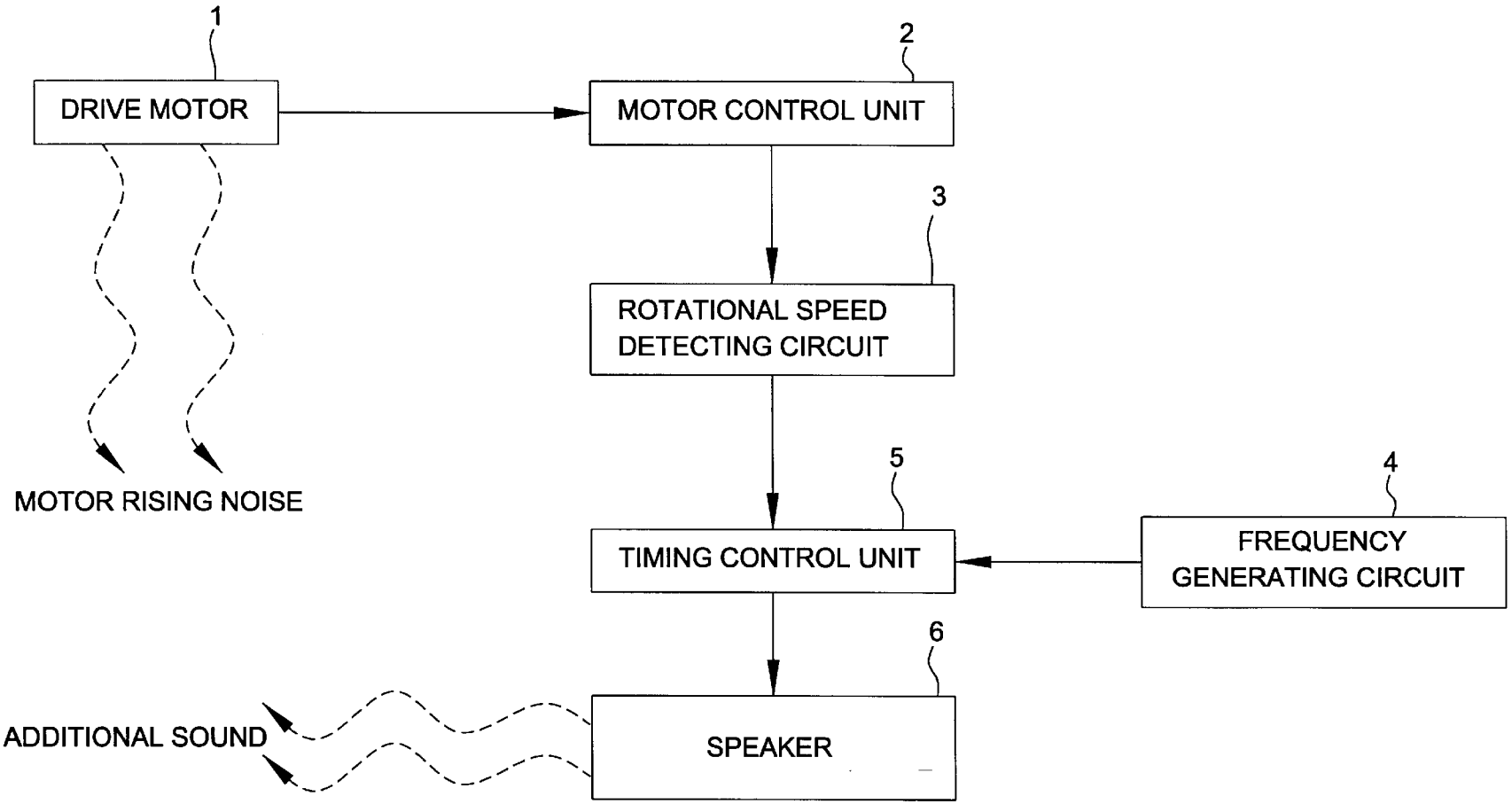
FIG. 1 is a block diagram embodying the construction of a noise masking device of an image forming apparatus according to the present invention.

Initially, a first embodiment of the present invention is explained. FIG. 1 is a block diagram embodying the construction of a noise masking device for an image forming apparatus of the first embodiment of the present invention. In FIG. 1, designated at numeral 1 is a drive motor, 2 is a motor control circuit, 3 is a rotational speed detecting circuit, 4 is a frequency generating circuit, 5 is a timing control circuit and 6 is a speaker.

In the block diagram of the noise masking apparatus shown in FIG. 1, the motor control circuit 2 obtains a signal related to the rotational speed from the drive motor 1 so as to control the rotational speed of the drive motor 1. For example, if the drive motor 1 is driven by magnetic force of a permanent magnet, the magnetic flux density in the vicinity of the permanent magnet is measured, whereby the number of changing between N pole and S pole is detected by using a number of zero points of magnetic flux density. Then, the number obtained by dividing the number of changing between N pole and S pole by the number of poles of the permanent magnet is obtained as a rotational speed signal of the drive motor 1.

The rotational speed detecting circuit 3 obtains the rotational speed signal by the signal obtained from the motor control circuit 2. The obtained rotational speed signal is transmitted from the rotational speed detecting circuit 3 to the timing control circuit 5 with the rotational speed signal of the next step. The timing control circuit 5 reads from the frequency generating circuit 4 a plurality of frequencies stored beforehand on this timing. Then, the timing control circuit 5 compares the rotational speed stored beforehand upon operating the drive motor 1 with that obtained by the rotational speed detecting circuit 3 to thereby detect the operational state, and further recognizes the speed-rise state by the difference between the present and the next rotational signals.

The timing control circuit 5 transmits a signal of the plurality of frequencies to the speaker 6 in synchronism with the change of the rotational speed from the stand-by state, to thereby generate an additional sound (masking sound) from the speaker 6. This additional sound is added to the speed-rise noise produced from the drive motor 1, thereby masking the noise generating upon speed-rising of the drive motor 1. Explained subsequently is a series of process for masking the speed-rise noise of the drive motor as described above.

Figure 2:
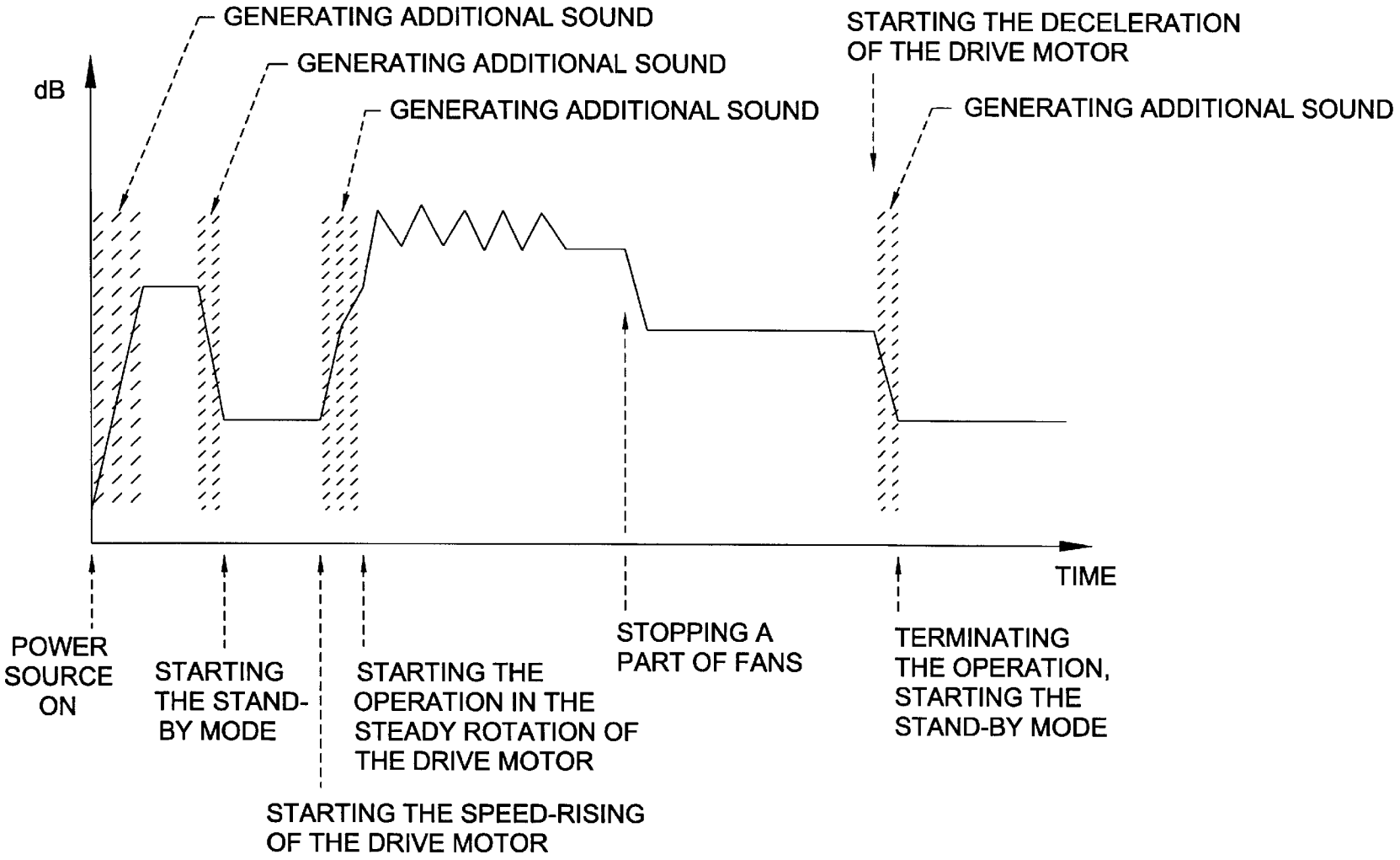
FIG. 2 is a view explaining a timing of the generation of an additional sound with respect to a noise of a drive motor.

FIG. 2 is a view for explaining the timing of generating the additional sound with regard to the noise of the drive motor. Shown by the shaded portion in FIG. 2 is a timing for generating the additional sound corresponding to the noise generation upon operational timing of the drive motor. When a power source is turned on, the rotational speed of the drive motor increases to the predetermined rotational speed upon speed-rising as shown in FIG. 2. At this time, the jarring noise due to the frequency fluctuation occurs. Therefore, a first additional sound is generated at this time. After the rotational speed of the drive motor rises, the drive motor continues rotating at a constant speed. Thereafter, the apparatus is brought into the stand-by mode if the further operation does not start. During the period when the rotational speed is decreased to bring the apparatus into a resting state, the jarring noise due to the frequency fluctuation occurs. Therefore, a second additional sound is generated here.

When a beginning of procedures such as image forming is instructed after the stand-by mode with low constant rotational speed, the drive motor starts up for increasing the rotational speed to the predetermined speed to thereby start the operational drive of the drive motor for the procedures. When the rotational speed is increasing, the jarring noise is generated due to a large frequency fluctuation, so that a third additional sound is produced at this time. After the procedures such as image forming is completed to terminate the operational drive of the drive motor, a part of fans stops rotating. The rotational speed is decreased for reduction in electricity, and the rotation in the predetermined period is continued. The additional sound is not produced during the decrease of the rotational speed since its frequency fluctuation is small. After the continuous rotation in the predetermined period, the drive motor is started to decelerate to the rotational speed in the stand-by mode. The drive motor keeps the rotational speed in the stand-by mode to maintain the stand-by state. During the rapid deceleration of the rotational speed, the jarring noise is generated due to the frequency fluctuation, so that a fourth additional sound is produced.

When the rotational speed of the drive motor is varied, the jarring noise is generated due to the frequency fluctuation. Every time the jarring noise is generated, the additional sounds (first to fourth sounds) for masking the noise are produced according to the frequency fluctuation of the rotational speed of the drive motor as described above.

Subsequently explained is a relationship between the time variation of the additional sound and the frequency. Generally, the type of the sounds producing from the drive motor 1 are mainly classified into three; an electromagnetic sound generating from an electromagnetic coil or a steel core upon switching over the electric current sent to the drive motor, a sound of a wind through the air caused by friction between the rotational polygon mirror and air, and a sound of a bearing caused by a mechanical contact of a shaft and a bearing. The electromagnetic sound described here is close to a pure sound having a sharp peak in a shallow frequency band, and the sound of the wind through the air is a fluid noise having a gentle peak in a wide frequency band. The sound of the bearing is close to the pure sound having a lot of sharp peaks according to the shape and dimension when a ball bearing is used. The sound of the bearing is not observed in using an air bearing. It has been known that the frequencies of these sounds establish a proportional relation to the rotational speed of the drive motor.

Figure 3:
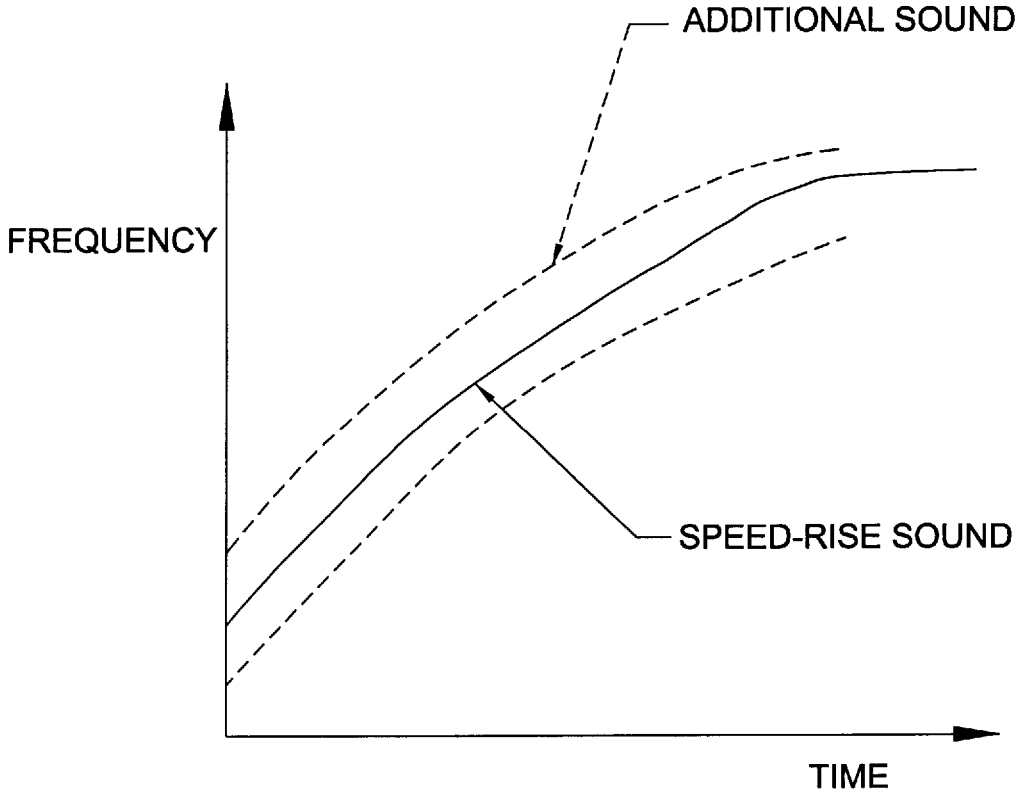
FIG. 3 is a view showing a relationship between the time variation of the additional sound and a rising-up noise.

FIG. 3 shows a relation between the time variation of the additional sound and the speed-rise noise. A curve shown by a solid line in FIG. 3 is a change of the main component frequency of the sound generating upon speed-rising of the drive motor 1. The main component frequency described here, which corresponds to the rotational speed of the drive motor, is a frequency having a large sound pressure level when the sound of the drive motor 1 is executed for spectral analysis. The speed of the drive motor 1 rises from the state where the rotational speed is zero or from the stand-by mode where the rotational speed is not zero. Accordingly, the frequency of its speed-rise noise increases with time as shown in FIG. 3. The pure sound of which frequency is varied brings unpleasant feeling.

As similarly shown in FIG. 3, the additional sound shown by a hatching is generated in synchronism with the speed-rise noise and overlaps with the noise, with the result that the speed-rise noise is masked in order that the frequency fluctuation of the speed-rise noise is auditorily recognized. Namely, the additional sounds consisting of a plurality of frequencies are positioned, with respect to the pure sound of the speed-rise noise, in both sides of the main component frequency of the speed-rise noise, to thereby afford a sound having auditorily wider band compared with the main component frequency.

Figure 4A:
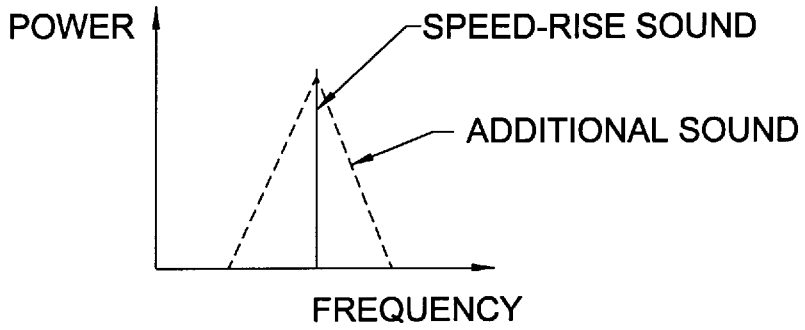
FIGS. 4A to 4C are views explaining frequency distributions of the additional sound comprising a plurality of frequencies.
Figure 4B:
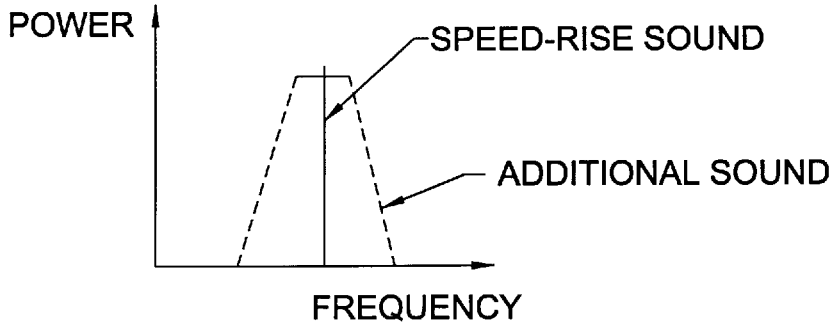
Figure 4C:
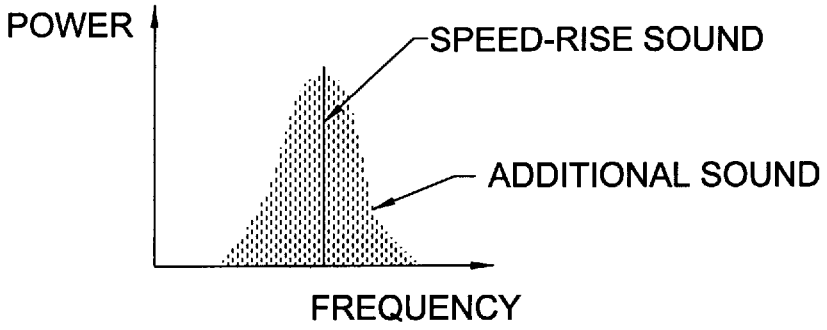

FIGS. 4A 4C are explanatory views showing frequency distributions of the additional sounds consisting of the plurality of frequencies. The additional sounds consisting of the plurality of frequencies described here is a sound comprising a plurality of frequencies having the frequency distribution which is symmetrical or almost symmetrical with respect to the main component frequency of the speed-rise noise as shown in FIGS. 4A to 4C. In other words, the frequency distribution corresponds to any one of the sound having the frequency of a triangular distribution as shown in FIG. 4A, the sound having the frequency of a trapezoidal distribution as shown in FIG. 4B and the sound having the frequency of a normal distribution as shown in FIG. 4C.

The sound comprising the plurality of frequencies having the frequency distribution as described above is added as the additional sound to the speed-rise noise of the drive motor. Then, the speed-rise noise is masked with the additional sound to form a sound of auditorily wider band compared with the main component frequency, so that the main component frequency is difficult to be recognized. In this case, the motor control circuit 2 controls to send an electric current which is larger than that sent in the steady state to the drive motor 1 in the first stage of the speed-rise in order to shorten the speed-rise time of the drive motor 1, as well as controls to make the electric current small to restrain the overshoot as the rotational speed approaches the predetermined speed. Therefore, the sound due to frequency fluctuation of the pure sound (sound of the main component frequency) varying with time brings psychologically unpleasant feeling. This pure sound is masked by adding the additional sound.

On the other hand, in the case of the composite sound composed of some frequencies, the auditory feeling of a person who hears this sound is influenced by the composed sound, i.e., the sound of the frequency component to be added. Therefore, the sound of the wide band comprising a plurality of frequencies is added to the main component frequency of the sound generating upon the speed-rise, whereby the main component frequency is difficult to be recognized.

At this time, the frequency distribution of the additional sound is made such that its power decreases as the frequency is apart from the main component frequency. As a result, the rough at both sides of the additional sound is eliminated to be capable of smoothly mixing the main component frequency with the additional sound. Therefore, the main component frequency is further difficult to be recognized. Moreover, the band of the frequency of the additional sound keeps constant as the main component frequency periodically fluctuates, whereby the spread of the sound to a person hearing the sound makes constant. Namely, the main component frequency is difficult to be recognized while eliminating the variation of the feelings or the sense of incongruity of the person hearing the sound.

Figure 5:
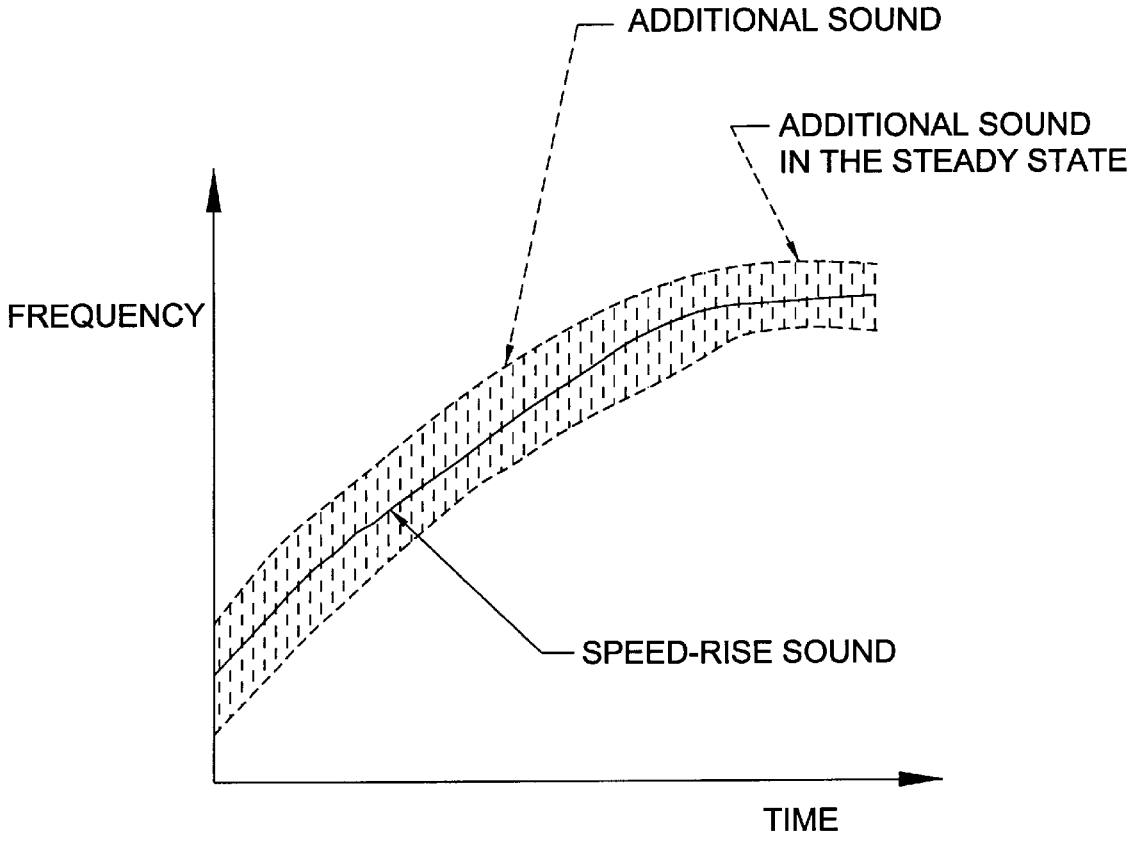
FIG. 5 is a view showing a relationship between the time variation of the additional sound including the state in normal operation and the rising-up noise.

FIG. 5 shows a relationship between the time variation of the additional sound including the state in normal operation and the speed-rise noise. In case of adding the additional sound having the plurality of frequencies to the speed-rise noise of the pure sound type, the band of the frequency of the additional sound keeps constant as the main component frequency periodically fluctuates as described above, whereby the spread of sound to a person hearing the sound makes constant. In order to eliminate the variation of feeling or the sense of incongruity, for example, the additional sound is continuously added to the steady sound after the speed-rise as shown in FIG. 5. By this, the main component frequency is still more difficult to be recognized.

In the case where the additional sound comprising the plurality of frequencies is added to the speed-rise noise of the drive motor to mask the noise as in the present embodiment, the effect obtained by the masking is evaluated by an individual person of an individual audition. Therefore, the loudness of the additional sound is capable of being adjusted according to the auditory taste of the individual person. The embodiment modified in this way will be explained as a second embodiment.

Figure 6:
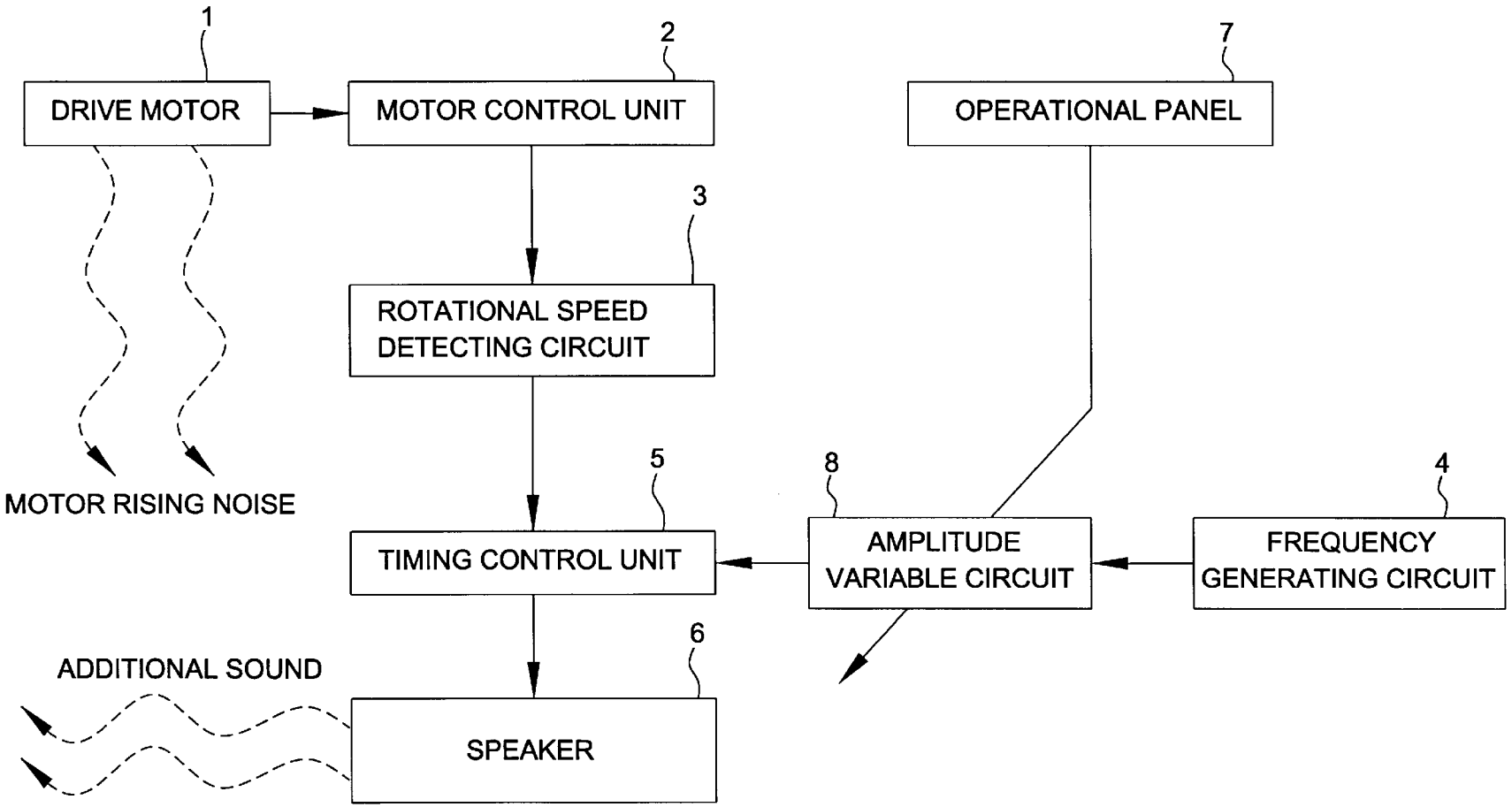
FIG. 6 is a block diagram embodying the construction of a noise masking device for an image forming apparatus of the second embodiment of the present invention.

FIG. 6 is a block diagram embodying the construction of a noise masking device for an image forming apparatus of the second embodiment of the present invention. In FIG. 6, designated at numeral 1 is a drive motor, 2 is a motor control circuit, 3 is a rotational speed detecting circuit, 4 is a frequency generating circuit, 5 is a timing control circuit and 6 is a speaker. These are the same as those in the first embodiment (FIG. 1). Designated at numeral 7 is an operational panel and 8 is an amplitude variable circuit.

A noise masking device of an image forming apparatus in a second embodiment is explained with reference to the construction view shown in FIG. 6. In the second embodiment, the device is provided with the operational panel 7 and the amplitude variable circuit 8. The amplitude of the additional sound having the plurality of frequencies supplied to the timing control circuit 5 from the frequency generating circuit 4 is adjusted by using the amplitude variable circuit 8 according to the instruction from the operational panel 7.

Namely, the rotational speed detecting circuit 3 detects the change in the rotational speed upon rising up or falling down the drive motor 1 by the observation of the control signal of the motor control circuit 2 to be transmitted to the timing control circuit 5. The timing control circuit 5 generates the additional sound so that the plurality of frequencies produced beforehand are positioned at both sides of the main component frequency by the plurality of frequency generating circuits 4 with the detected signal as a trigger. In this case, the timing control circuit 5 outputs the additional sound as a sound wave by operating the speaker 6 in synchronism with the periodical fluctuation of the main component frequency.

The operator sets the loudness of the additional sound outputted from the speaker 6 by operating the operational panel 7 such that the jarring noise generated from the image forming apparatus is eased or the sound suits his or her taste. The suitable signal from the operational panel 7 is sent to the amplitude variable circuit 8 which varies the amplitude of the sound used as the additional sound having the plurality of frequencies by this signal and produces from the speaker 6 as a sound wave. The resultant sound is made to have auditorily wider band compared with the main component frequency by this sound wave. Accordingly, the operator operates the operational panel 7 to adjust the degree of the sound recognition for setting such that the main component frequency is not recognized by the operator or persons around the apparatus. In this way, the unpleasant feeling is restrained according to the individual taste.

In the case where the additional sound comprising the plurality of frequencies is added to the speed-rise noise of the drive motor to mask the speed-rise noise as in the above-mentioned second embodiment, the loudness of the additional sound can be adjusted according to the auditory taste of an individual person. However, there is troublesome to individually adjust the additional sound. In order to overcome this troublesome, the apparatus can be constructed to execute automatic adjustment. By this construction, the adjustment of the amplitude with respect to the additional sound for masking the noise is automatically executed. Further, a minute adjustment may be performed according to the individual taste as is similar in the second embodiment. The masking device having the above-mentioned construction will be explained as a third embodiment.

Figure 7:
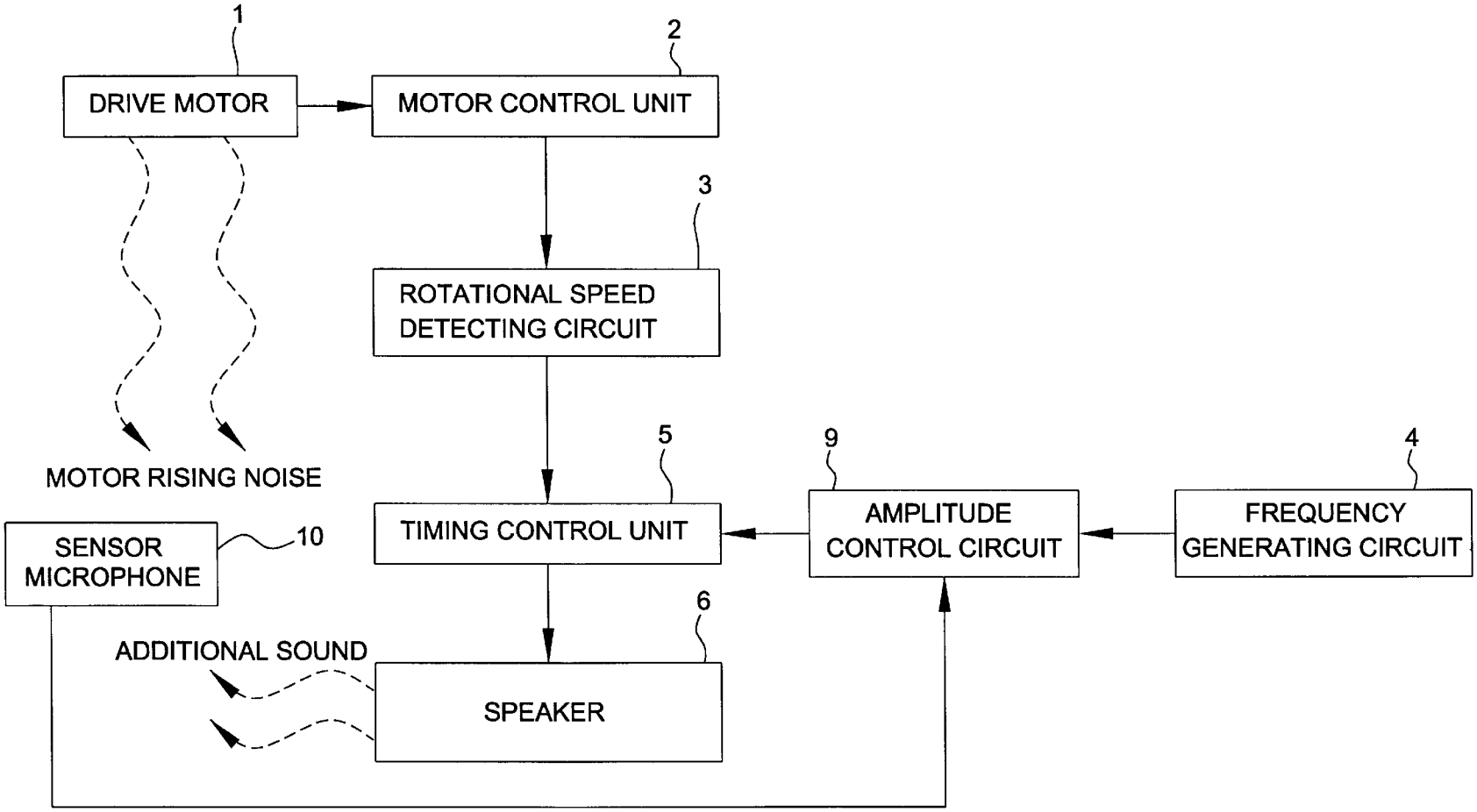
FIG. 7 is a block diagram embodying the construction of a noise masking device for an image forming apparatus of the third embodiment of the present invention.

FIG. 7 is a block diagram embodying the construction of a noise masking device for an image forming apparatus of the third embodiment of the present invention. In FIG. 7, designated at numeral 1 is a drive motor, 2 is a motor control circuit, 3 is a rotational speed detecting circuit, 4 is a frequency generating circuit, 5 is a timing control circuit and 6 is a speaker. These are the same as those in the first embodiment (FIG. 1). Designated at numeral 9 is an amplitude control circuit and 10 is a sensor microphone for observing the speed-rise noise.

A noise masking device of an image forming apparatus in a third embodiment is explained with reference to the construction view shown in FIG. 7. In the third embodiment, the device is provided with the amplitude control circuit 9 and the sensor microphone 10 in addition to the constructions shown in the first embodiment. The sensor microphone 10 observes the speed-rise noise and the amplitude control circuit 9 automatically adjusts the amplitude of the additional sound by the observed signal. Namely, the apparatus is constructed such that the amplitude of the additional sound having the plurality of frequencies supplied to the timing control circuit 5 from the frequency generating circuit 4 is automatically adjusted by the amplitude control circuit 9 corresponding to the detected output from the sensor microphone 10.

The third embodiment shown in FIG. 7 is the development of the construction in the second embodiment shown in FIG. 6. In other words, the apparatus of the third embodiment is provided with the sensor microphone 10 for observing the speed-rise noise and the amplitude control circuit 9 which corresponds to the amplitude variable circuit 7 of the second embodiment. By this construction, the amplitude of the main component frequency of the speed-rise noise is always observed by the sensor microphone 10, whereby the observed signal is sent to the amplitude control circuit 9 to actively control the increase or decrease in the amplitude with respect to the periodical fluctuation of the main component frequency. By this, the amplitude can be kept at a predetermined state in accordance with the environmental change or another change in several conditions of the main component frequency, to thereby stably restrain the unpleasant feeling.

FIG. 8 is a view illustrating the frequency distribution of the additional sound in the case where the plurality of frequencies serving as the additional sound is the set of the pure sound type. The pure sound type is suitable for the additional sound having the plurality of frequencies in the above-mentioned respective embodiments. As illustrated in FIG. 8, with respect to the additional sound having the dispersed frequency distribution, a plurality of pure sounds are newly added, for example, in the vicinity of both sides of the main component frequency of the pure sound type to form the additional sound.

At this time, supposing that the frequency increases from $f_0$ Hz to $(f_1+f_0)$ Hz in $t_1$ seconds by $f_1$, the wave form is represented by:

$$y=A_0 \sin\{2n(f_0t+f_1t^2/(2t_1))\}.$$

With respect to this pure sound, when the pure sounds having the amplitude of $A_1$ is newly added to both sides thereof at $\pm a_1$ Hz, the wave form is represented by:

$$\begin{aligned} y &= A_0\sin\{2n(f_0t+f_1t^2/(2t_1))\}+ \\ &\quad A_1\cos[2n\{(f_0\pm a_1)t+f_1t^2/(2t_1)\}] \\ &= 2\sin\{2n(f_0t+f_1t^2/(2t_1))\}\{A_0+A_1\cos(2na_1t)\}. \end{aligned}$$

Similarly, the plurality of pure sounds are added, i.e., the new pure sounds having the amplitude of $A_n$ are added to $\pm a_n$ Hz, the wave form is represented by:

$$y=2 \sin\{2n(f_0t+f_1t^2/(2t_1))\}\{A_0+A_1 \cos(2na_1t)+A_2 \cos(2na_2t)+\ldots\}.$$

The term "$\sin\{2n(f_1t+f_0t^2/(2t_1))\}$" represents the frequency of the original pure sound, and the term "$\{A_0+A_1\cos(2na_1t)+A_2\cos(2na_2t)+\ldots$" represents the component of howl, the frequency of which fluctuates with time. Likewise, the term "$\{A_0+A_1\cos(2na_1t)+A_2\cos(2na_2t)+\ldots$" is similar to the Fourier series expansion. Namely, it is possible to expand the arbitral function by arbitrarily selecting $A_0, A_1, \ldots, a_1, a_2, \ldots$ FIG. 9 is a view explaining the embodying example of the decrease of the noise in the case where the plurality of the frequencies of the pure sound type mutually interferes with the main component frequency to control the sound pressure. For example, if the coefficient of the above-mentioned Fourier series is $$A_n=½'', a_n=0.1n \text{ Hz},$$

the characteristics is obtained as shown by a curve line in FIG. 9. The characteristics shown by the curve line brings a larger sound pressure than that of the original sound at t<1.5 sec, as well as brings a smaller sound pressure than that of the original sound at t>1.5 sec. Namely, the sound pressure becomes large in the relatively low frequency area of the speed-rise noise, but can be restrained in the high frequency area causing unpleasant feeling. Accordingly, the degree in feeling the noise such as noisiness, unpleasantness and getting on ones nerve is reduced by mutually interfering the plurality of the frequencies of the pure sound type with the main component frequency to control the sound pressure.

EXPERIMENTAL EXAMPLE

Figure 11:
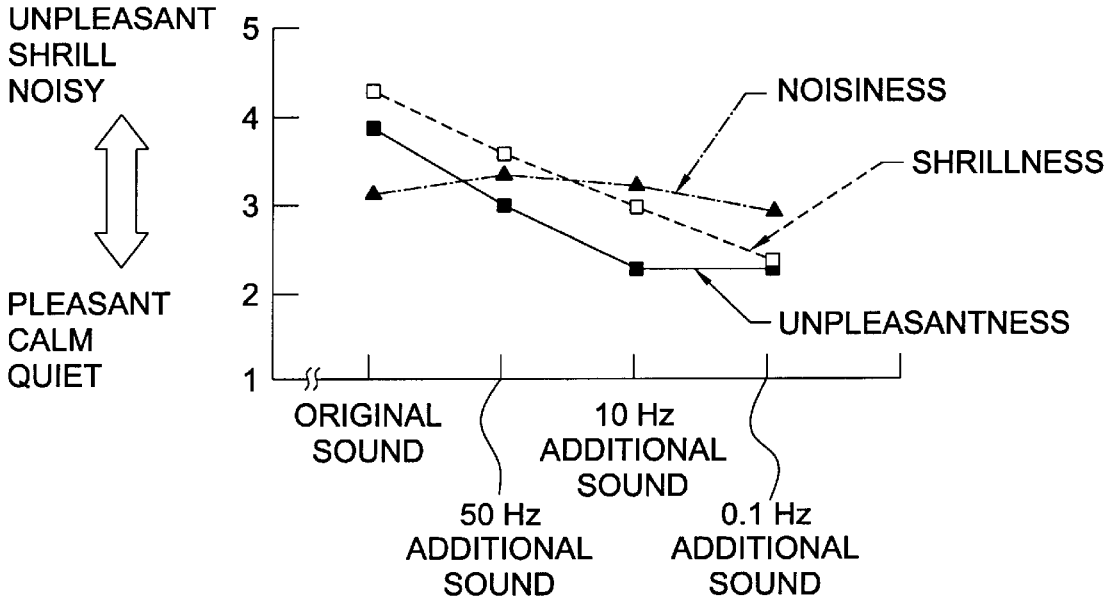
FIG. 11 is a view showing evaluating results by the category evaluating method.
Figure 12:
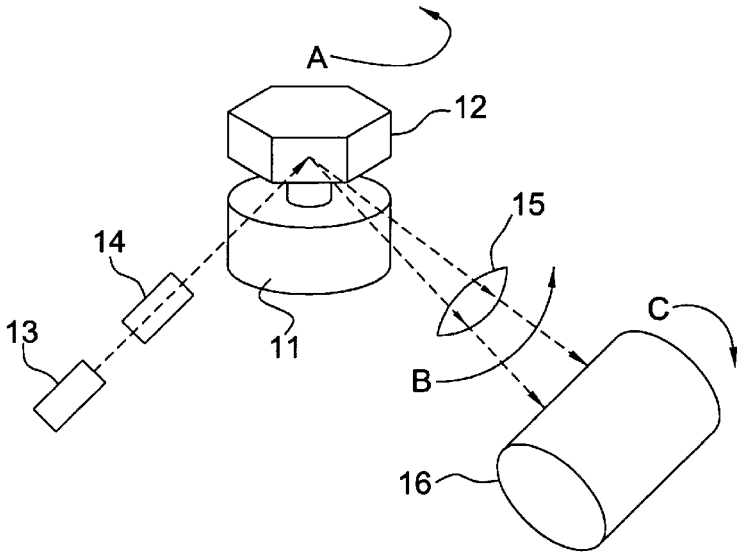
FIG. 12 is a perspective view showing a construction of a light deflector.
Figure 13:
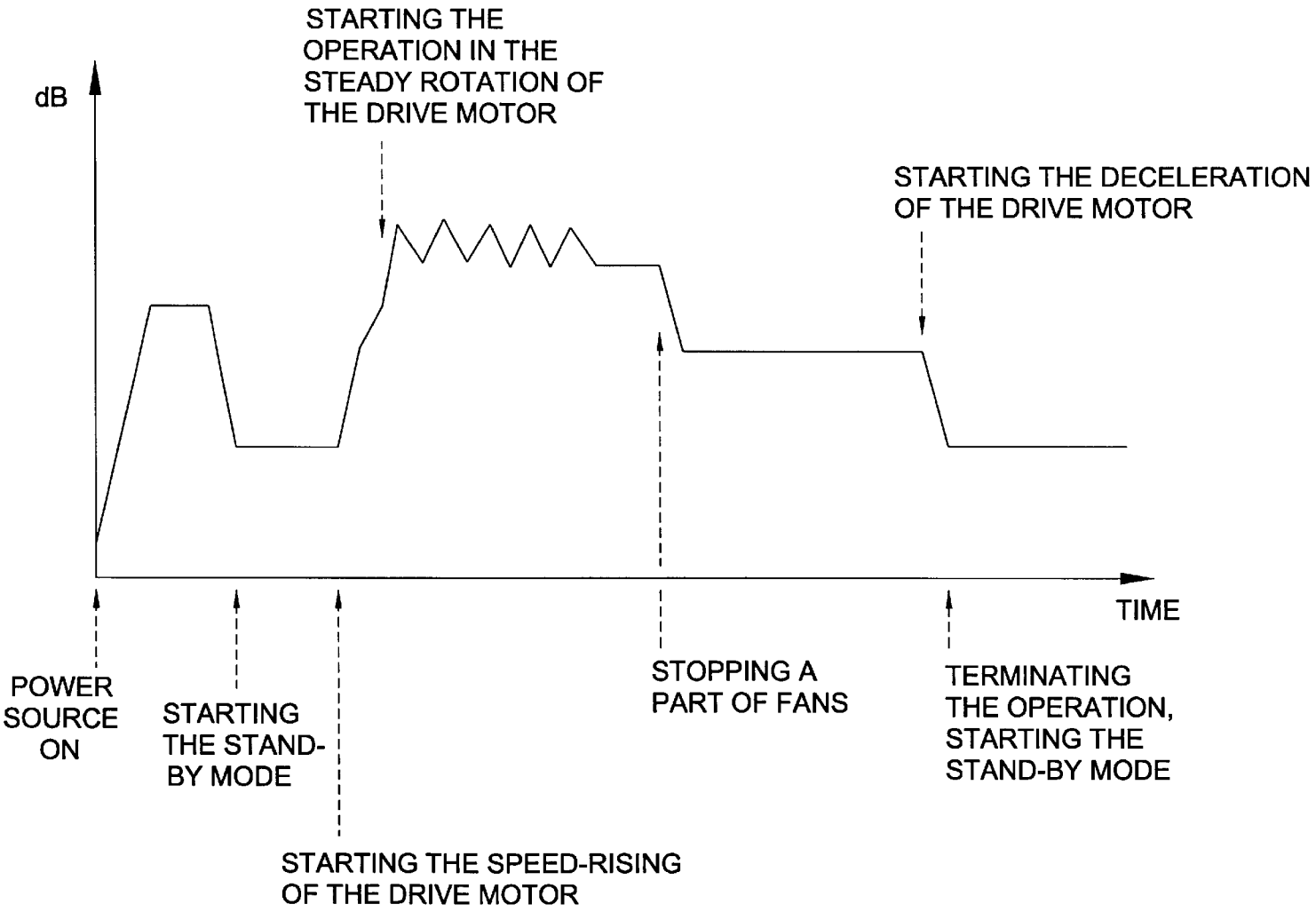
FIG. 13 is a view explaining the noise variation due to the change in rotational speed of a drive motor of an optical scanning device.

A sincere evaluation test was performed to confirm the effect of the masking of the noise according to the above-mentioned present invention. Concretely, a plurality of pure sounds are added at an interval of 0.1 Hz, 10 Hz and 50 Hz at both sides of the main component frequency of the noise occurring upon the speed-rise of the drive motor 1 to form a sound. This resultant sound was heard by the examinees consisting of 18 members to evaluate in the items noisiness, unpleasantness and shrillness. The evaluation was performed by using an evaluating table comprising grades as shown in FIG. 10. The category evaluating method was utilized for rating on five levels 20 as to the items unpleasantness 21, shrillness 22, and noisiness 23. FIG. 11 is a graph showing the result of the evaluation. As is understood by the graph showing the result of the evaluation, the improvement was observed by the noise masking device of the present invention such that the unpleasantness was reduced by 31% at its maximum compared with the original sound.

The improvement was further observed such that the item shrillness was reduced by 35% at its maximum compared with the original sound. It is to be noted that there was little change in the item noisiness. As described above, it was confirmed that shrillness and unpleasantness were improved without increasing the noisiness by adding the plurality of the pure sounds to the main component frequency of the sound occurring upon the speed-rise of the drive motor 1.

As explained above, according to the present invention, with respect to the main component frequency of the noise which occurs when the speed of the drive motor rises up to a predetermined rotational speed or falls down, the rotational speed on the speed-rise or the speed-fall of the drive motor is detected, so that the plurality of frequencies positioned at both sides of the main component frequency are generated in synchronism with the periodical variation of the main component frequency from the speaker as the additional sound for masking the noise, thereby being capable of providing a small-sized and low-cost image forming apparatus such as a laser beam printer and a copier which brings no psychological unpleasantness due to the frequency fluctuation.

What is claimed is:

1. A noise masking device of an image forming apparatus which is provided with a drive motor, comprising:

detection means for detecting a rotational speed of the drive motor;

signal generating means for generating a correlation signal which utilizes the detection means to correlate with the rotational speed of said drive motor;

a speaker for generating a masking sound which masks a noise produced by said drive motor; and masking sound control means for controlling said speaker to vary said masking sound corresponding to the variation in said correlation signal.

2. A noise masking device as claimed in claim 1, wherein said masking sound control means varies a frequency of said masking sound corresponding to the variation in said correlation signal.

3. A noise masking device as claimed in claim 1, wherein said masking sound control means varies a sound pressure of said masking sound corresponding to the variation in said correlation signal.

4. A noise masking device as claimed in claim 1, wherein said masking sound is a pure sound type masking sound having a remarkable peak of the sound pressure at a particular frequency.

5. A noise masking device as claimed in claim 4, wherein a frequency distribution of said pure sound type masking sound is a symmetric distribution with respect to said particular frequency.

6. A noise masking device as claimed in claim 4, wherein a frequency distribution of said pure sound type masking sound is a triangular distribution with respect to said particular frequency.

7. A noise masking device as claimed in claim 4, wherein a frequency distribution of said pure sound type masking sound is a trapezoidal distribution with respect to said particular frequency.

8. A noise masking device as claimed in claim 4, wherein a frequency distribution of said pure sound type masking sound is a normal distribution with respect to said particular frequency.

9. A noise masking device of an image forming apparatus which is provided with a drive motor, comprising:

signal generating means for sensing a noise produced by said drive motor to generate a correlation signal which correlates with said noise;

a speaker for generating a masking sound which masks the noise produced by said drive motor; and masking sound control means for uninterrupted control of said speaker to continuously vary, in a non-sampling fashion, said masking sound corresponding to the variation in said correlation signal.

10. A noise masking device as claimed in claim 9, wherein said masking sound control means varies a frequency of said masking sound corresponding to the variation in said correlation signal.

11. A noise masking device as claimed in claim 9, wherein said masking sound control means varies a sound pressure of said masking sound corresponding to the variation in said correlation signal.

12. A noise masking device as claimed in claim 9, wherein said masking sound is a pure sound type masking sound having a remarkable peak of the sound pressure at a particular frequency.

13. A noise masking device as claimed in claim 12, wherein a frequency distribution of said pure sound type masking sound is a symmetric distribution with respect to said particular frequency.

14. A noise masking device as claimed in claim 12, wherein a frequency distribution of said pure sound type masking sound is a normal distribution with respect to said particular frequency.

15. A noise masking method for an image forming apparatus which is provided with a drive motor, comprising the steps of:

detecting a rotational speed of the motor;

generating a correlation signal by using the detected rotational speed of the motor to correlate the correlation signal with the rotational speed of said drive motor;

varying a masking sound for masking a noise produced by said drive motor corresponding to the variation in said correlation signal; and generating the varied masking sound from a speaker.

16. A noise masking method as claimed in claim 15, wherein a frequency of said masking sound is varied corresponding to the variation in said correlation signal.

17. A noise masking method as claimed in claim 15, wherein a sound pressure of said masking sound is varied corresponding to the variation in said correlation signal.

18. A noise masking method as claimed in claim 15, wherein said masking sound is a pure sound type masking sound having a remarkable peak of the sound pressure at a particular frequency.

19. A noise masking method as claimed in claim 18, wherein a frequency distribution of said pure sound type masking sound is a symmetric distribution with respect to said particular frequency.

20. A noise masking method as claimed in claim 18, wherein a frequency distribution of said pure sound type masking sound is a normal distribution with respect to said particular frequency.

* * * * *